US008035302B2

(12) United States Patent
Hong

(10) Patent No.: US 8,035,302 B2
(45) Date of Patent: Oct. 11, 2011

(54) PLASMA DISPLAY PANEL WITH COLORED FIRST AND SECOND PHOSPHORS

(75) Inventor: Chong-Gi Hong, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 63 days.

(21) Appl. No.: 11/979,575

(22) Filed: Nov. 6, 2007

(65) Prior Publication Data

US 2008/0129201 A1 Jun. 5, 2008

(30) Foreign Application Priority Data

Nov. 7, 2006 (KR) ..... 10-2006-0109579

(51) Int. Cl.
*H01J 17/49* (2006.01)

(52) U.S. Cl. ..... 313/582; 313/586; 313/587

(58) Field of Classification Search ..... 313/582–587
See application file for complete search history.

(56) References Cited

U.S. PATENT DOCUMENTS

| | | | | |
|---|---|---|---|---|
| 5,838,105 | A | 11/1998 | Mitomo | |
| 6,008,582 | A * | 12/1999 | Asano et al. | 313/582 |
| 7,109,658 | B2 | 9/2006 | Yoo et al. | |
| 7,208,875 | B2 | 4/2007 | Kwon et al. | |
| 7,235,927 | B2 | 6/2007 | Yoo | |
| 7,432,655 | B2 | 10/2008 | Yoo et al. | |
| 7,501,757 | B2 | 3/2009 | Kang | |
| 7,750,568 | B2 | 7/2010 | Kang et al. | |
| 2001/0026255 | A1 * | 10/2001 | Sano et al. | 345/60 |
| 2003/0146699 | A1 * | 8/2003 | Lee | 313/582 |
| 2006/0175971 | A1 * | 8/2006 | Yoo et al. | 313/586 |
| 2006/0226778 | A1 | 10/2006 | Choo | |
| 2007/0216306 | A1 * | 9/2007 | Kim | 313/582 |
| 2007/0228976 | A1 * | 10/2007 | Ko | 313/586 |
| 2007/0241681 | A1 * | 10/2007 | Yoo et al. | 313/582 |

FOREIGN PATENT DOCUMENTS

| | | | |
|---|---|---|---|
| CN | 1 585 075 | A | 2/2005 |
| CN | 1 702 819 | A | 11/2005 |
| EP | 0 554 172 | B1 | 4/1998 |
| JP | 10-027550 | A | 1/1998 |
| JP | 11-043670 | A | 2/1999 |

(Continued)

OTHER PUBLICATIONS

Japanese Office Action in JP 2007-220006, dated Apr. 13, 2010 (Hong).

(Continued)

*Primary Examiner* — Joseph L Williams
*Assistant Examiner* — Kevin Quarterman
(74) *Attorney, Agent, or Firm* — Lee & Morse, P.C.

(57) ABSTRACT

A plasma display panel includes a front substrate providing an image display surface, a rear substrate facing the front substrate, barrier ribs arranged between the front and rear substrates to defining a plurality of discharge cells, a plurality of discharge electrodes extending across the discharge cells to generate a discharge, a front dielectric layer on the front substrate to bury the discharge electrodes, first phosphors coated within the discharge cells, second phosphors on upper surfaces of the barrier ribs and extending from the first phosphors, and a discharge gas filled into the discharge cells, wherein one or more of the front substrate, the front dielectric layer, and/or the barrier ribs is colored with a first color, and the first and second phosphors are colored with a second color.

24 Claims, 8 Drawing Sheets

FOREIGN PATENT DOCUMENTS

| | | | |
|---|---|---|---|
| JP | 2000-106092 | A | 4/2000 |
| JP | 2001-060439 | | 3/2001 |
| JP | 2005-063943 | A | 3/2005 |
| JP | 2005-063961 | A | 3/2005 |
| JP | 2006-004647 | A | 1/2006 |
| JP | 2006-114482 | A | 4/2006 |
| JP | 2006-253161 | A | 9/2006 |
| KR | 10-2005-0119909 | A | 12/2005 |

OTHER PUBLICATIONS

Chinese Registration Determination Certificate, CN 101178998 B, dated Mar. 2, 2011.

* cited by examiner

PLASMA DISPLAY PANEL WITH COLORED FIRST AND SECOND PHOSPHORS

BACKGROUND OF THE INVENTION

1. Field of the Invention

Embodiments of the present invention relate to a plasma display panel (PDP). More particularly, embodiments of the present invention relate to a PDP with an improved bright room contrast.

2. Description of the Related Art

Plasma display panels (PDPs) refer to flat display panels that display images using a gas discharge phenomenon. Such display panels may provide excellent display capabilities, e.g., large-capacity display, high brightness, high contrast, low image sticking, a wide-range of viewing angle, and so forth, and a thin/large screen, as compared to conventional cathode ray tube (CRT) displays. Conventionally, PDPs may display images by generating a discharge within a plurality of discharge cells arranged between two substrates, using ultraviolet (UV) rays generated during the discharge to excite a phosphor material in the discharge cells to trigger emission of visible light, and emitting the visible light to the outside of the PDPs.

The conventional phosphor material of the PDPs may have a substantially white color, and may be deposited in the discharge cells to emit red, green, and/or blue lights upon excitation. The phosphor material may be deposited in the discharge cells via, e.g., a dispenser method. The conventional dispenser method may include continuous deposition of a phosphor paste by, e.g., nozzle spraying at a constant speed, so the phosphor paste may be deposited inside and outside the discharge cells. For example, the conventional dispenser method may cause deposition of the phosphor paste on upper surfaces of portions of barrier ribs facing a front substrate of the PDP. However, deposition of a white-colored phosphor paste on portions of the barrier ribs facing the front substrate may increase reflection of external light. In other words, when visible external light is transmitted through a transparent front substrate of the PDP toward the discharge cells, the light may be reflected from white surfaces within the PDP, e.g., phosphor paste, barrier ribs, and so forth, to the outside of the PDP, thereby reducing bright room contrast of the PDP.

SUMMARY OF THE INVENTION

Embodiments of the present invention are therefore directed to a plasma display panel (PDP), which substantially overcomes one or more of the disadvantages of the related art.

It is therefore a feature of an embodiment of the present invention to provide a PDP with elements colored according to a subtractive mixture principle to improve image quality.

It is another feature of an embodiment of the present invention to provide a PDP structure with colored phosphors capable of improving reducing reflection of external light.

At least one of the above and other features and advantages of the present invention may be realized by providing a PDP, including a front substrate providing an image display surface, a rear substrate facing the front substrate, barrier ribs arranged between the front and rear substrates to defining a plurality of discharge cells, a plurality of discharge electrodes extending across the discharge cells to generate a discharge, a front dielectric layer on the front substrate to bury the discharge electrodes, first phosphors coated within the discharge cells, second phosphors on upper surfaces of the barrier ribs and extending from the first phosphors, and a discharge gas filled into the discharge cells, wherein one or more of the front substrate, the front dielectric layer, and/or the barrier ribs is colored with a first color, and the first and second phosphors are colored with a second color.

The first color and the second color may be different from each other. The first color and the second color may be complementary to each other. The first color may be substantially blue or substantially orange, and the second color may be substantially orange or substantially blue, respectively. The first phosphors may include red phosphors, green phosphors, and blue phosphors, at least one of the red, green, and blue phosphors being colored with the second color. The red and blue phosphors may be colored with the second color and the green phosphors may be not colored. The barrier ribs may include vertical barrier rib portions extending parallel to each other between discharge cells and horizontal barrier rib portions extending parallel to each other to connect the vertical barrier rib portions. The second may be on at least upper surfaces of the horizontal barrier rib portions. The PDP may further include grooves in the horizontal barrier rib portions along the second direction, the second phosphors being in the grooves. The barrier ribs may further include bridges along the first direction, each bridge positioned between two horizontal barrier rib portions. The second phosphors may be on upper surfaces of the horizontal barrier rib portions and of the bridges.

The front substrate may be colored with the first color and at least upper surfaces of the barrier ribs may be colored with a third color. The third color of the barrier ribs may be complementary with respect to the first color of the front substrate. The third color of the barrier ribs may be substantially identical to the second color of the first and second phosphors. The third color of the barrier ribs and the second color of the first and second phosphors may be complementary with respect to the first color of the front substrate. The front dielectric layer may be colored with a fourth color. The fourth color of the dielectric layer may be complementary with respect to the second color of the first and second phosphors. The fourth color of the front dielectric layer may be substantially identical to the first color of the front substrate. The fourth color of the front dielectric layer and the first color of the front substrate may be complementary with respect to the second color of the first and second phosphors. The front dielectric layer may be colored with the first color and at least front portions of the barrier ribs may be colored with a third color. The third color of the barrier ribs may be complementary with respect to the first color of the front dielectric layer. The third color of the barrier ribs may be substantially identical to the second color of the first and second phosphors. The third color of the barrier ribs and the second color of the phosphor may be complementary with respect to the first color of the front dielectric layer. At least upper surfaces of the barrier ribs may be colored with the first color. The first phosphors and the second phosphors may be coated according to a dispenser method in a single cycle.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Figure 1:
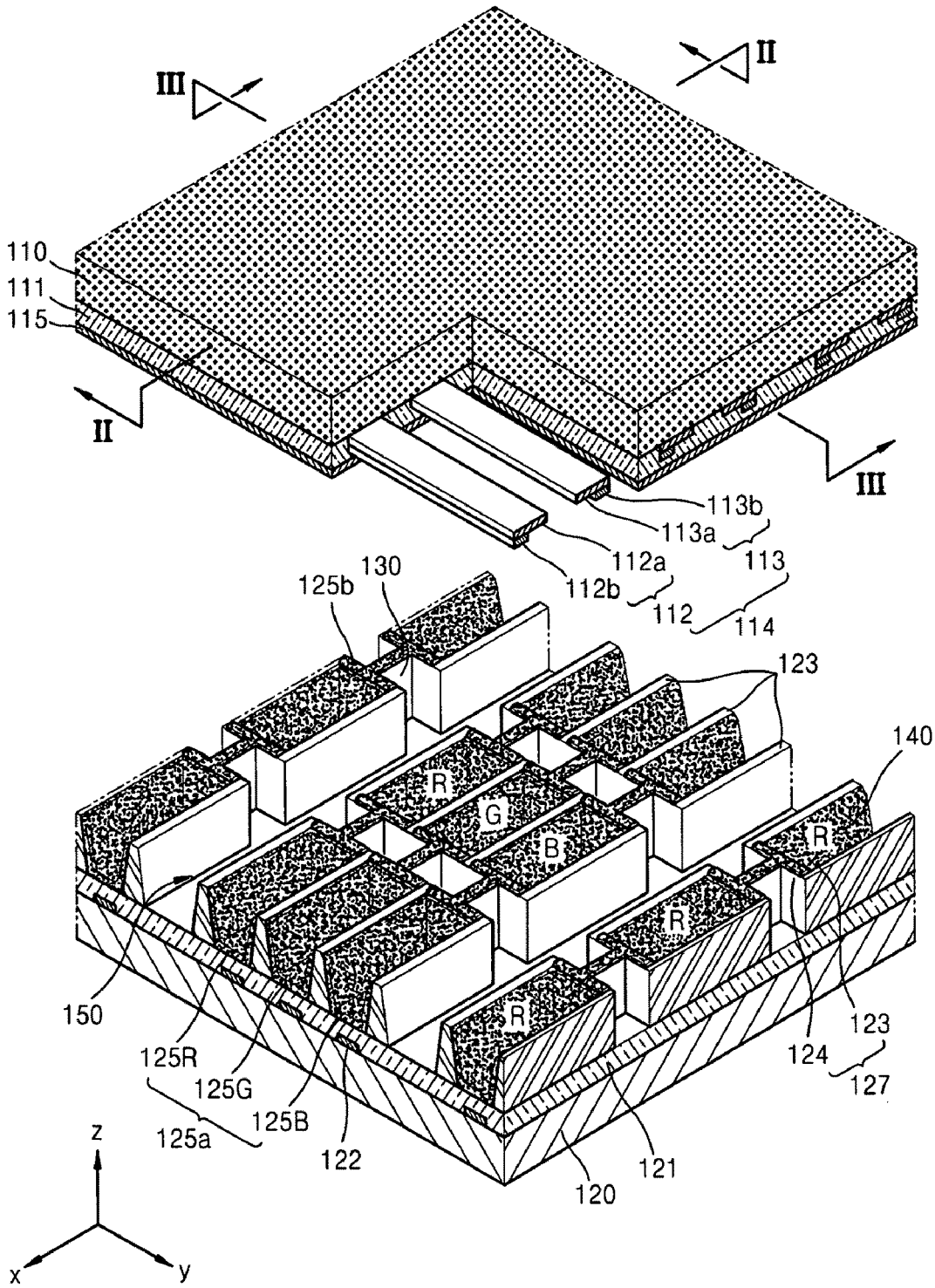
FIG. 1 illustrates an exploded perspective view of a plasma display panel (PDP) according to an embodiment of the present invention.

Korean Patent Application No. 10-2006-0109579, filed on Nov. 7, 2006, in the Korean Intellectual Property Office, and entitled: "Plasma Display Panel," is incorporated by reference herein in its entirety.

Embodiments of the present invention will now be described more fully hereinafter with reference to the accompanying drawings, in which exemplary embodiments of the invention are illustrated. Aspects of the invention may, however, be embodied in different forms and should not be construed as limited to the embodiments set forth herein. Rather, these embodiments are provided so that this disclosure will be thorough and complete, and will fully convey the scope of the invention to those skilled in the art.

In the figures, the dimensions of layers and regions may be exaggerated for clarity of illustration. It will also be understood that when a layer or element is referred to as being "on" another layer, element, or substrate, it can be directly on the other layer, element or substrate, or intervening layers and/or elements may also be present. Further, it will be understood that when a layer or element is referred to as being "under" another layer or element, it can be directly under, or one or more intervening layers and/or elements may also be present. In addition, it will also be understood that when a layer or element is referred to as being "between" two layers or elements, it can be the only layer or element between the two layers or elements, or one or more intervening layers and/or elements may also be present. Like reference numerals refer to like elements throughout.

An exemplary embodiment of a plasma display panel (PDP) according to the present invention will be described with reference to FIGS. 1-4. Referring to FIGS. 1-4, a PDP may include front and rear substrates 110 and 120 facing each other, barrier ribs 127 arranged between the front and rear substrates 110 and 120 to define a plurality of discharge cells 140 therebetween, discharge and address electrodes 114 and 122 between the front and rear substrates 110 and 120, and phosphors 125. The PDP may further include front and rear dielectric layers 111 and 121 on inner surfaces of the front and rear substrates 110 and 120, respectively, to bury the discharge and address electrodes 114 and 122, respectively. The front dielectric layer 111 may be coated with a protective film 115 formed of, e.g., magnesium oxide (MgO). A discharge gas may be filled into the discharge cells 140.

The front substrate 110 and the rear substrate 120 of the PDP may be spaced apart by a predetermined interval to define a discharge space therebetween, and may be formed of, e.g., glass. Hereinafter, an "inner surface" of any element and/or layer refers to a surface facing the discharge cells 140 between the front and rear substrates 110 and 120, as opposed to facing away from the discharge cells 140.

The barrier ribs 127 of the PDP may include a plurality of vertical barrier portions 123 extending along a first direction, e.g., along the x-axis, between adjacent discharge cells 140, and horizontal barrier portions 124 extending along a second direction, e.g., along the y-axis, to connect the vertical barrier portions 123. The barrier ribs 127 may be arranged in a matrix pattern, so the vertical and horizontal barrier portions 123 and 124 may intersect to form the plurality of the discharge cells 140 therebetween. The discharge cells 140 may be arranged into groups of three to emit red (R), green (G), and blue (B) colors, so each discharge cell 140 may correspond to a R, G, and/or B sub-pixel. A group of three discharge cells 140 may form a unit pixel with corresponding R, G, and B sub-pixels.

Each discharge cell 140 representing a sub-pixel of a unit pixel may be separated from an adjacent discharge cell in a same unit pixel by, e.g., a vertical barrier portion 123, as illustrated in FIG. 1. Each group of three discharge cells 140, i.e., a unit pixel, may be separated from an adjacent group of three discharge cells 140 along the second direction by an exhaust path 150, as illustrated in FIG. 1. Each exhaust path 150 may extend along the first direction between vertical barrier portion 123, and may function both as an exhaust path for gas removal and as an inflow path for the discharge gas. Each discharge cell 140, i.e., a sub-pixel, may be separated from an adjacent discharge cell 140 along the first direction by a barrier rib bridge 130, as further illustrated in FIG. 1. The barrier rib bridges 130 may be intermittently arranged between adjacent horizontal barrier portions 124 along the first direction, thereby minimizing shrinkage and/or deformation of the barrier ribs 127 during baking, e.g., during evaporation of a solvent included in a barrier rib paste. Accordingly, each group of three discharge cells 140, i.e., a unit pixel, may be separated from an adjacent group of three discharge cells 140 along the first direction by three barrier rib bridges 130, as illustrated in FIG. 1. The barrier rib bridges 130 may be integral with the barrier ribs 127.

Figure 2:
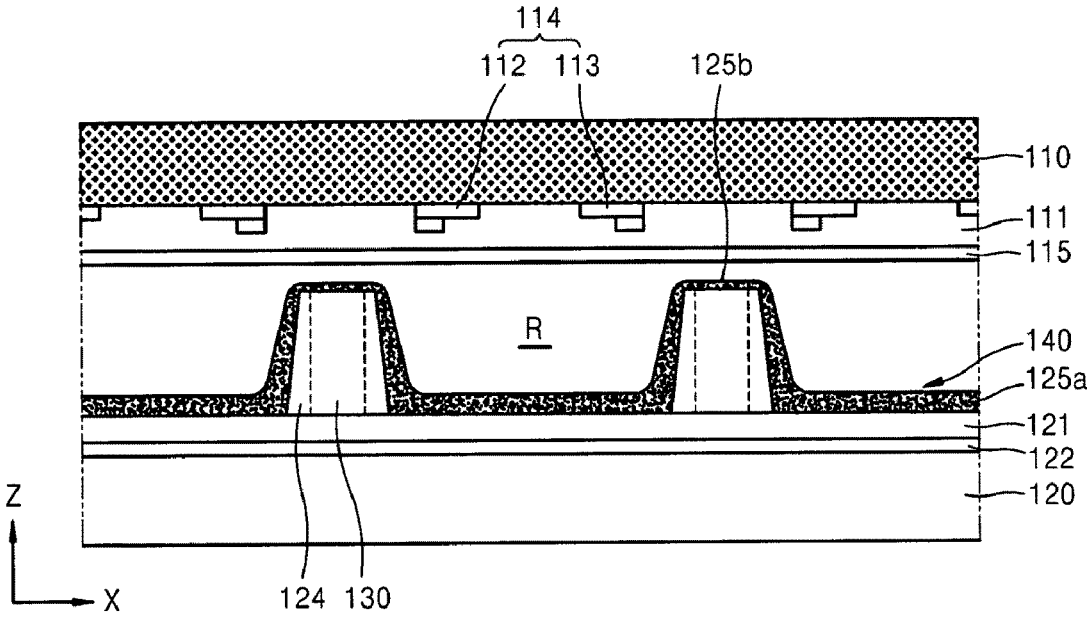
FIG. 2 illustrates a cross-sectional view along line II-II of FIG. 1.
Figure 3:
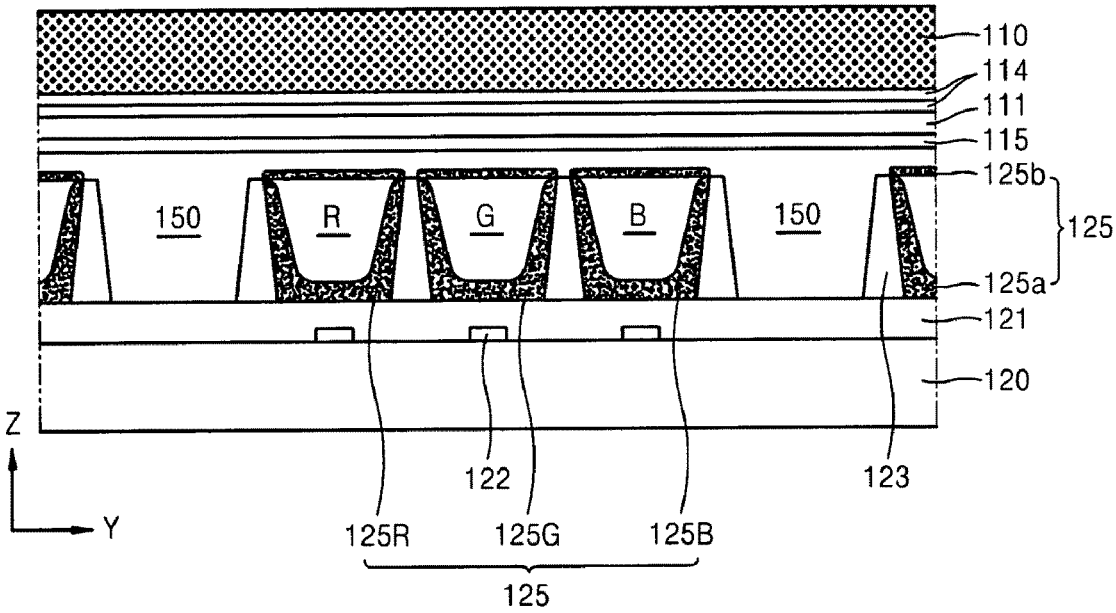
FIG. 3 illustrates a cross-sectional view along line III-III of FIG. 1.
Figure 4:
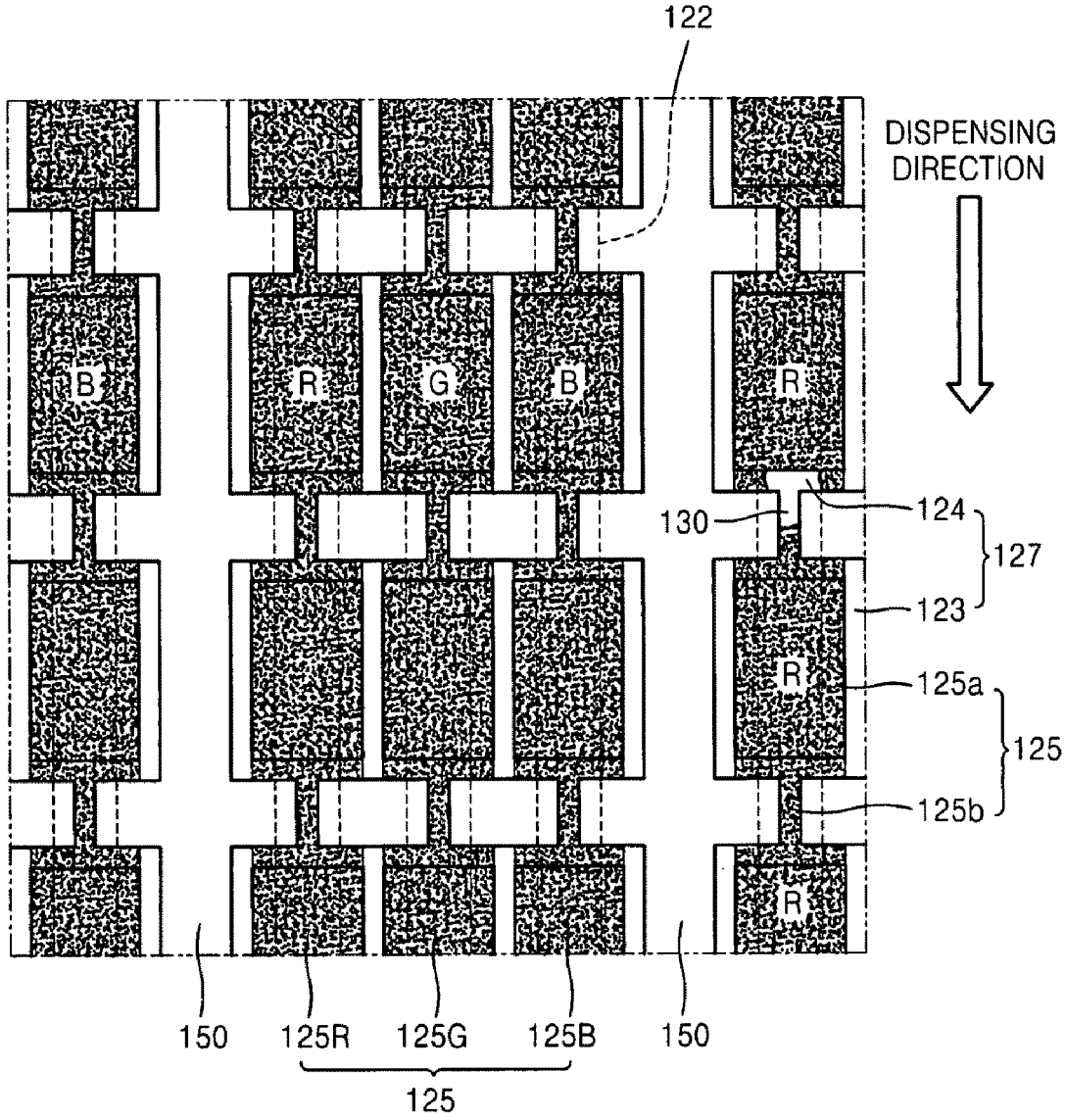
FIG. 4 illustrates a plan view of the PDP in FIG. 1.

The discharge electrodes 114 of the PDP may include a plurality of pairs of discharge electrodes 114 along the second direction. More specifically, each pair of discharge electrodes may include a scan electrode 112 and a sustain electrode 113 extending parallel to each other on an inner surface of the front substrate 110. The scan and sustain electrodes 112 and 113 may be arranged in an alternating pattern, and each may include a transparent electrodes 112*a* and 113*a*, respectively, and a bus electrode 112*b* and 113*b*, respectively. Each of the transparent electrodes 112*a* and 113*a* may be formed of a conductive and optically transparent material, e.g., indium tin oxide (ITO), and may be in direct contact with the front substrate 110, as illustrated in FIGS. 1-2. Each of the bus electrodes 112*b* and 113*b* may be formed of metal on an inner surface of a corresponding transparent electrode 112*a* and 113*a*, respectively, and may supply power thereto. The address electrodes 122 of the PDP may extend along the first direction in parallel to each other on an inner surface of the rear substrate 120, and may intersect with the discharge electrodes 114. Accordingly, each discharge cell 140 may correspond to one address electrode 122 and one pair of discharge electrodes 114.

The phosphors 125 of the PDP may include materials capable of emitting R, G, and B light upon excitation, e.g., red phosphors 125R, green phosphors 125G, and blue phosphors 125B. The phosphors 125 may be applied to form the sub-pixels, i.e., R, G, and B phosphors 125R, 125G, and 125B, as discussed previously. Accordingly, when the discharge gas is excited in the discharge cells 140 by a display discharge generated by the discharge electrodes 114, UV light may be generated to excite the R, G, and B phosphors 125R, 125G, and 125B. Each of the R, G, and B phosphors 125R, 125G, and 125B may emit a specific monochromatic light to be combined into a single color image.

The R, G, and B phosphors 125R, 125G, and 125B within each unit pixel may have any suitable arrangement. For example, a dispenser method, i.e., a nozzle continuously spraying a phosphor paste along a predetermined direction, may provide a layer of a phosphor paste to coat, e.g., a single column, of a plurality of adjacent discharge cells 114 in a single cycle, i.e., a single application. More specifically, as illustrated in FIG. 1, phosphors 125 of an identical color may be coated within a column of the discharge cells 140 along the x-axis, e.g., red phosphors 125R, so processing time may be reduced.

Further, the phosphors 125 may include first phosphor portions 125*a* within the discharge cells 140, i.e., on lateral surfaces of the barrier ribs 127 forming sidewalls of the discharge cells 140 and on the rear dielectric layer 121 forming a bottom surface of the discharge cells 140, and second phosphor portions 125*b* on upper surfaces, i.e., surfaces facing the front dielectric layer 110, of the horizontal barrier ribs 124 and of the barrier rib bridges 130. The second phosphor portions 125*b* may lead to the first phosphor portions 125*a* within the discharge cells 140. In this respect it is noted that "lead to" refers to a structure of the first and second phosphor portions 125*a* and 125*b*, where the first and second phosphor portions 125*a* and 125*b* may be formed through a single continuous dispenser method, such that the first and second phosphor portions 125*a* and 125*b* may have a substantially similar composition. The first and second phosphor portions 125*a* and 125*b* may or may not be in physical contact with one another.

The first and second phosphors 125*a* and 125*b* may have a complimentary color with respect to a color of the front substrate 110, as determined by a subtractive mixture method. More specifically, the front substrate 110 may be colored with a first color, and the first and second phosphor portions 125*a* and 125*b* may be colored with a second color complementary. For example, the first and the second colors may respectively be substantially blue and substantially orange, so the front substrate 110 may include one or more of manganese (Mn), nickel (Ni), and/or cobalt (Co) to impart a blue color thereto, and the first and second phosphor portions 125*a* and 125*b* may include one or more of copper (Cu), tin (Sb), and/or chromium (Cr) to impart an orange color thereto. Accordingly, as viewed through the front substrate 110, overlapping portions of the front substrate 110 and the first and second phosphor portions 125*a* and 125*b* may exhibit a substantially dark or opaque color, e.g., black, dark brown, dark blue, and so forth.

In other words, external light incident on the PDP may be absorbed by the black areas formed by overlapping portions of the front substrate 110 and the first and second phosphor portions 125*a* and 125*b*, and thus, reduce reflection of external light therefrom, which in turn, may improve bright room screen contrast of the PDP. Deposition of the phosphor layers 125 not only within the discharge cells 140 but on the upper surfaces of the horizontal barrier ribs 124 and barrier rib bridges 130, i.e., both first and second phosphor portions 125*a* and 125*b*, may enlarge an area capable of absorbing external light, thereby facilitating improvement of bright room contrast and overall image display.

Figure 5:
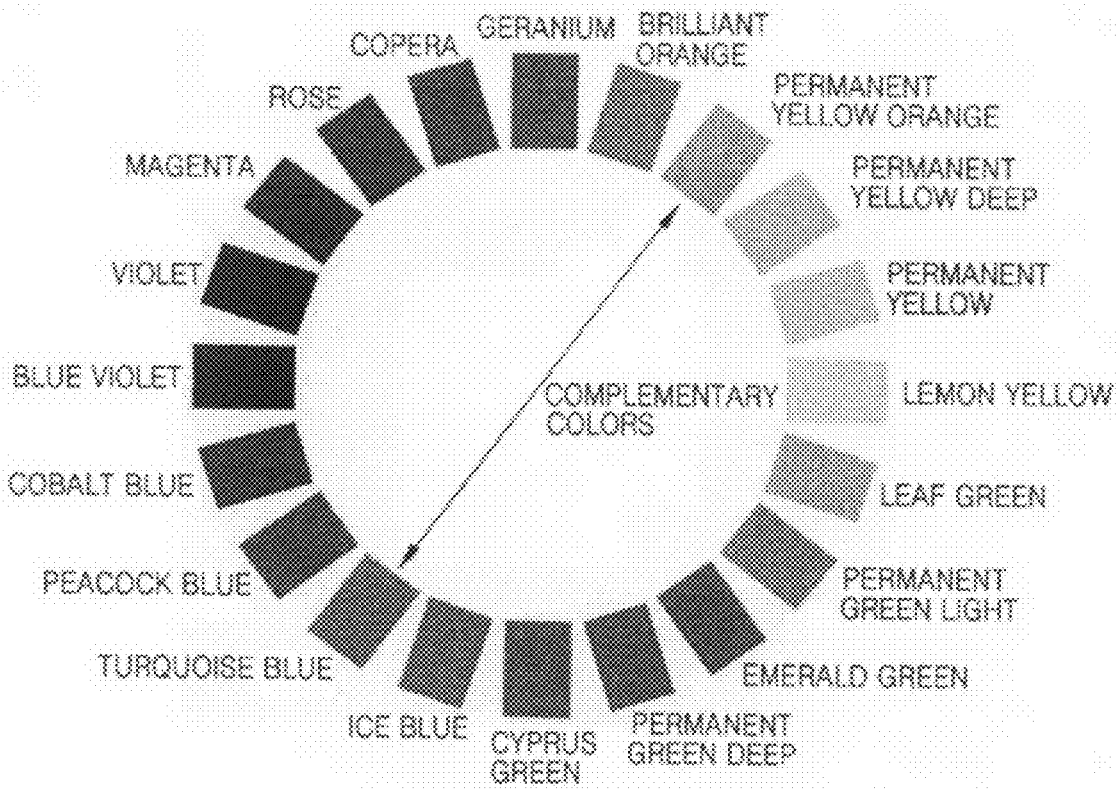
FIG. 5 illustrates a general color circle of subtractive/complementary color relationships.

In this respect, it is noted that the "subtractive mixing method" refers to a method of mixing colors to modify their brightness and saturation with respect to their position in a color ring illustrated in FIG. 5. For example, mixing two initial colors positioned closely to each other in the color ring may form a mixture having a secondary color positioned between the two initial colors in the color ring, and mixing two initial colors positioned far from each other in the color ring may form a mixture having a gray color. Further, mixing two initial colors positioned opposite to each other in the color ring, i.e., complementary colors, may form a mixture having a substantially dark or opaque color. It is further noted that proximity of colors in the color ring of FIG. 5, i.e., close, far, and/or opposite each other, refers to positions along the circumference of the color ring, so opposite points thereon may substantially form a diameter across the color ring. As illustrated in the color ring of FIG. 5, examples of pairs of complementary colors may include geranium and cyprus green, permanent yellow and cobalt blue, turquoise blue and permanent yellow orange, and so forth.

It should be noted that the front substrate 110 may be colorless. In other words, the front substrate may not be colored, so coloring of only the first and second phosphor portions 125*a* and 125*b* may be sufficient to minimize the white color of a conventional phosphor material, thereby reducing reflection of external light therefrom. It should be further noted that only a predetermined portion of the phosphors 125 may be colored in order to avoid a potential decrease in brightness.

In conventional displays, a color image may be formed by combining different intensities of monochromatic lights having different wavelength, e.g., red, green, and/or blue. However, in order to avoid a potentially reduced brightness due to addition of a coloring material into the phosphor material, only a portion of the phosphors 125 may be colored, i.e., as determined with respect to a type of a phosphor and/or its corresponding luminance characteristics. For example, the green phosphors 125G, i.e., material contributing about 50% of an overall brightness of the PDP, may not be colored due to their substantial brightness contribution to the PDP, and at least one of the red phosphors 125R and one of the phosphors 125B in each unit pixel may be colored. In another example, the blue phosphors 125B may not be colored due to their lowest luminous efficiency, and at least one of the green phosphors 125G in each unit pixel may be colored.

Figure 6:
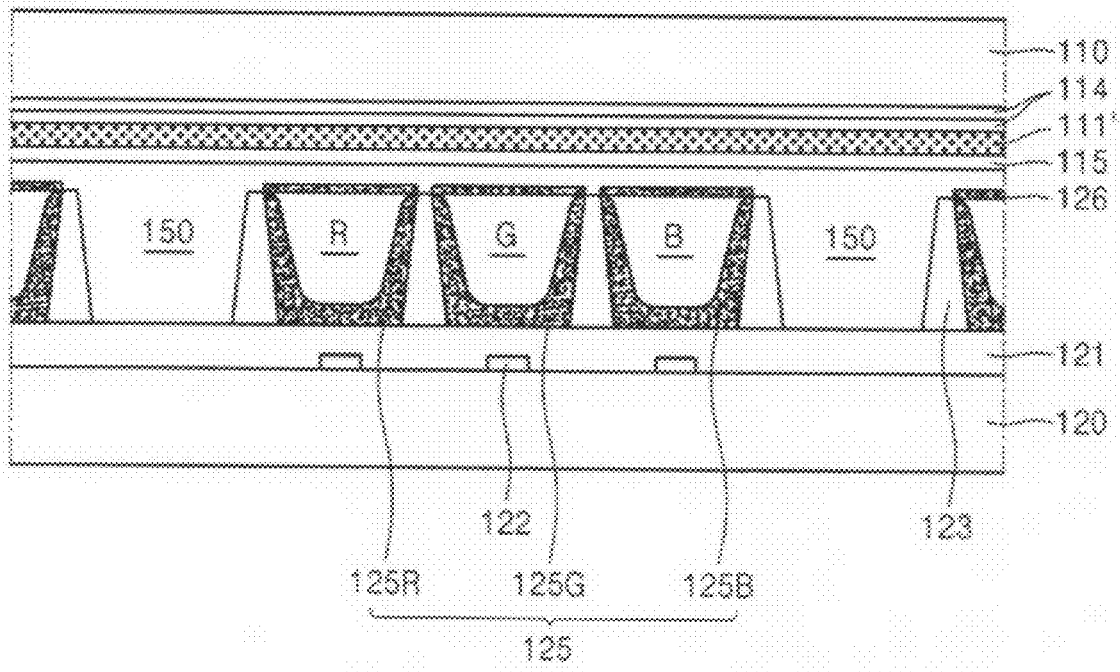
FIG. 6 illustrates a cross-sectional view of a PDP according to another embodiment of the present invention.

FIG. 6 illustrates a cross-sectional view of a PDP according to another embodiment of the present invention. The PDP illustrated in FIG. 6 may be substantially similar to the PDP described previously with respect to FIGS. 1-4, with the exception of having a colored front dielectric layer 111'. More specifically, the PDP illustrated in FIG. 6 may have a colored or a non-colored front substrate 110, and the front dielectric layer 111' may be colored with the first color, so the front dielectric layer 111' may be colored with a complimentary color with respect to the second color of the phosphor layers 125. Accordingly, as described previously with respect to FIGS. 1-4, overlapping portions between the front dielectric layer 111' and the first and second phosphor portions 125*a* and 125*b* in the PDP illustrated in FIG. 6 may have a substantially dark color, thereby enhancing absorption of external light. Color consideration and structure of the front dielectric layer 111' and the first and second phosphor portions 125*a* and 125*b* in the PDP illustrated in FIG. 6 may be substantially similar to those described previously with respect tot the PDP illustrated in FIGS. 1-4, and therefore, will not be repeated herein.

Figure 7:
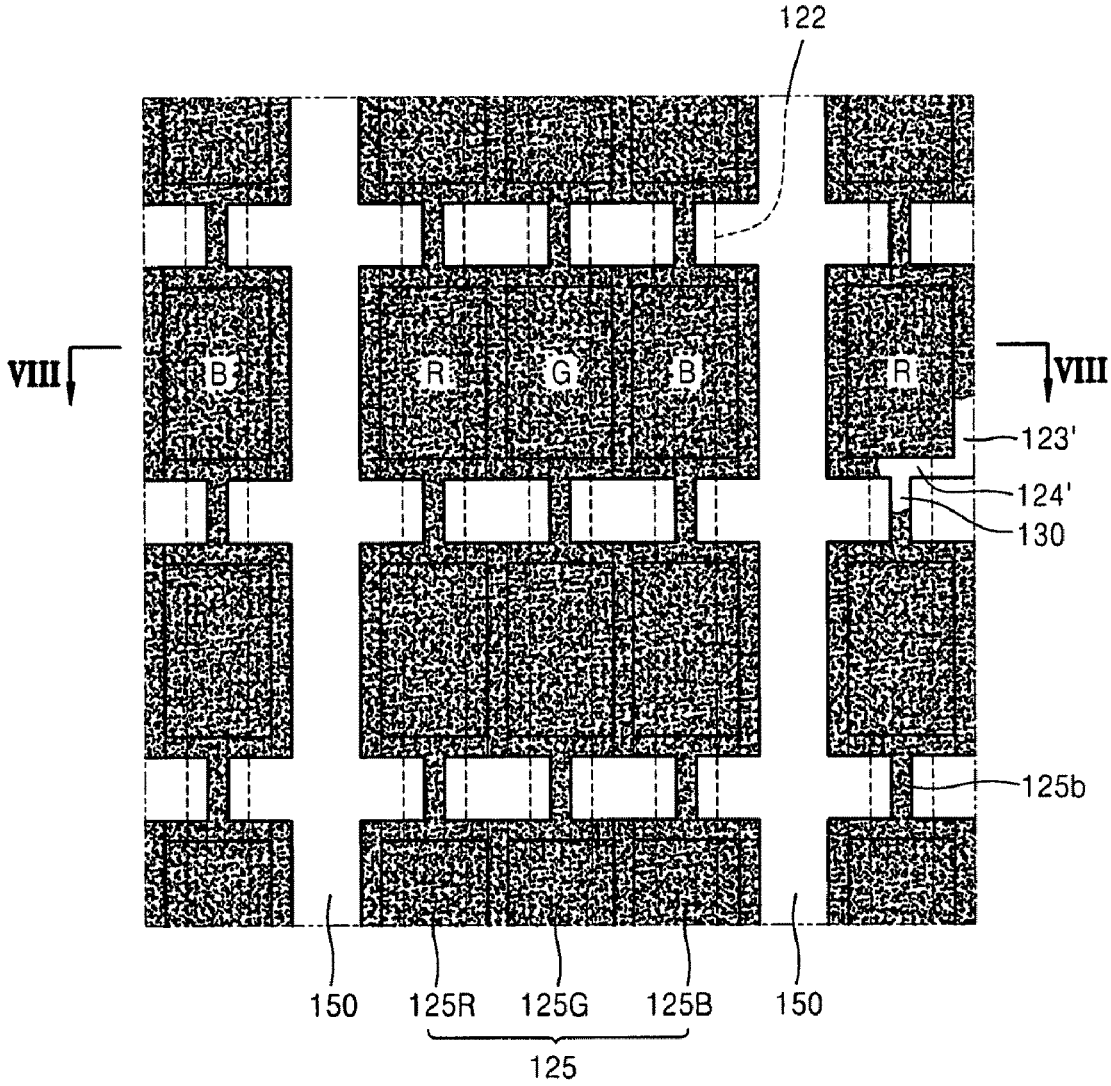
FIG. 7 illustrates a plan view of a PDP according to another embodiment of the present invention.
Figure 8:
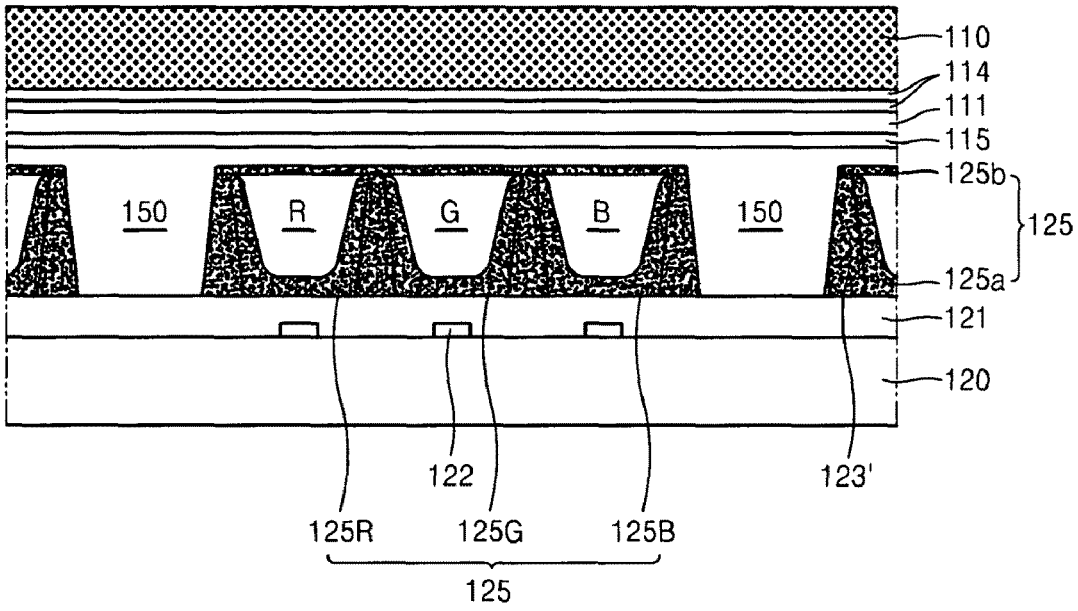
FIG. 8 illustrates a cross-sectional view along line VIII-VIII of FIG. 7.

FIGS. 7-8 illustrate respective plan and cross-sectional views of a PDP according to yet another embodiment of the present invention. The PDP illustrated in FIGS. 7-8 may be substantially similar to the PDP described previously with respect to FIGS. 1-4, with the exception of having vertical and horizontal barrier portions 123' and 124' colored with a third color. The third color may have a lower brightness than a substantially white color, so overlapping portions thereof with the first and second phosphor portions 125*a* and 125*b* may substantially reduce external light reflection. The third color may be selected with respect to the first color of the front substrate 110, i.e., complimentary colors as determined by a subtractive mixing method, in order to further decrease external light reflection. The third color may be either substantially similar to the first color of the first and second phosphor portions 125*a* and 125*b* or may be different. If the third color is different than the first color, the third color may be selected so that overlapping portions of the vertical barrier portions 123' with the front substrate 110 and overlapping portions of the horizontal barrier portions 124' with the second phosphor portions 125*b* and the front substrate 110 may have a substantially dark color.

As such, most of a display surface, i.e., a portion of the display area overlapping with the barrier ribs 127 and the discharge cells 140, may have a substantially dark or opaque color, i.e., a light emission area and a non-light-emission area, thereby accelerating external light absorption. Formation of a PDP with both light emission area and non-light-emission area having a substantially dark color may be advantageous in enlarging a light absorbing area and eliminating a necessity of using black stripes, as compared to a conventional art where external light absorption may be achieved only in a non-display area by using black stripes.

The vertical and horizontal barrier portions 123' and 124' may be colored so only surfaces thereof facing the front substrate 110 may be colored. In particular, coloring of the barrier ribs 127, e.g., by a dispenser method, may substantially reduce external light reflection and improve bright room contrast even when white phosphors are used. It should be noted, however, that coloring of other elements of the PDP, e.g., coloring of the front dielectric layer 111 with the first color in addition to or instead of coloring of the front substrate 110, are within the scope of the present invention.

Figure 9:
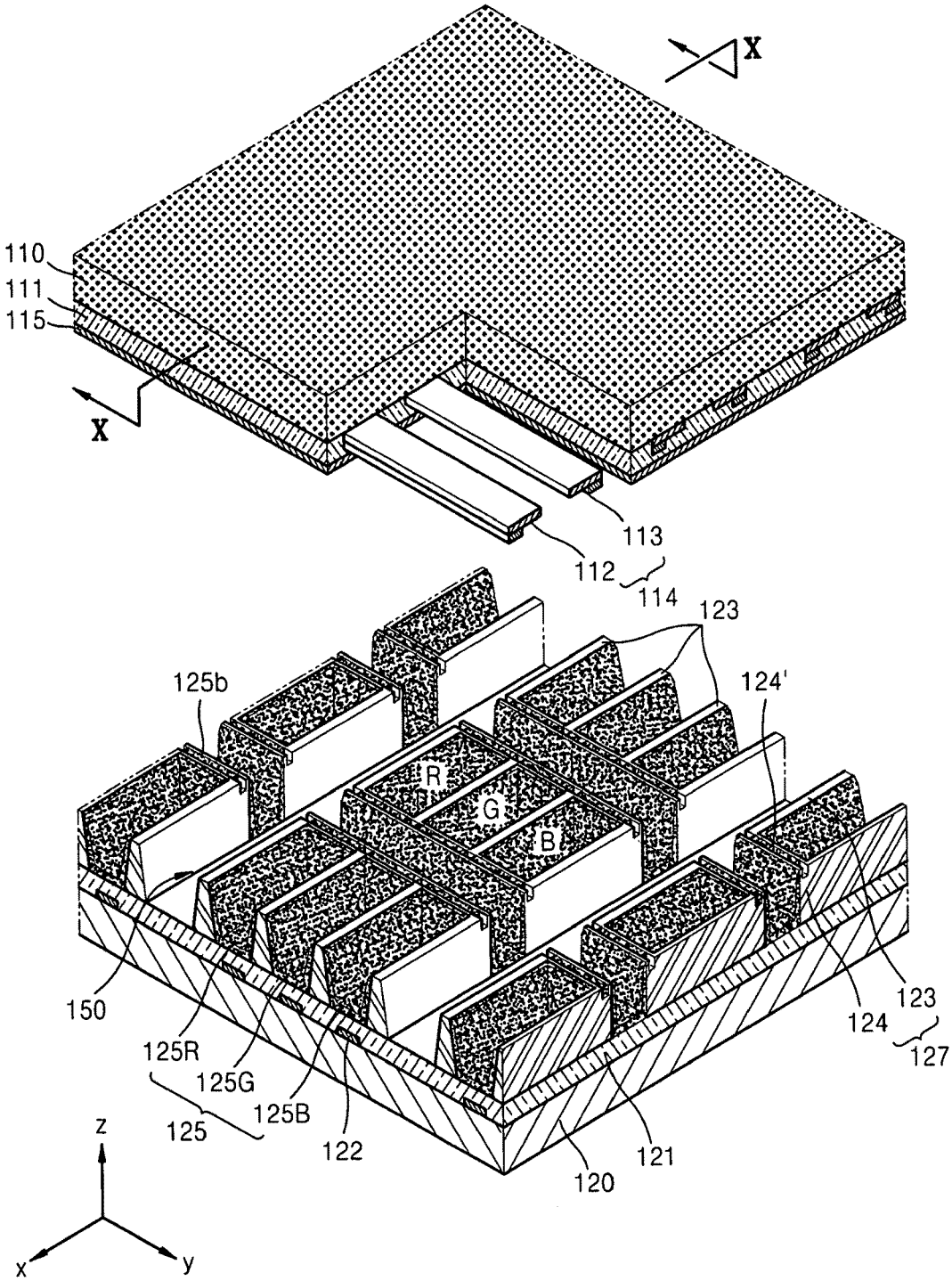
FIG. 9 illustrates an exploded perspective view of a PDP according to another embodiment of the present invention.
Figure 10:
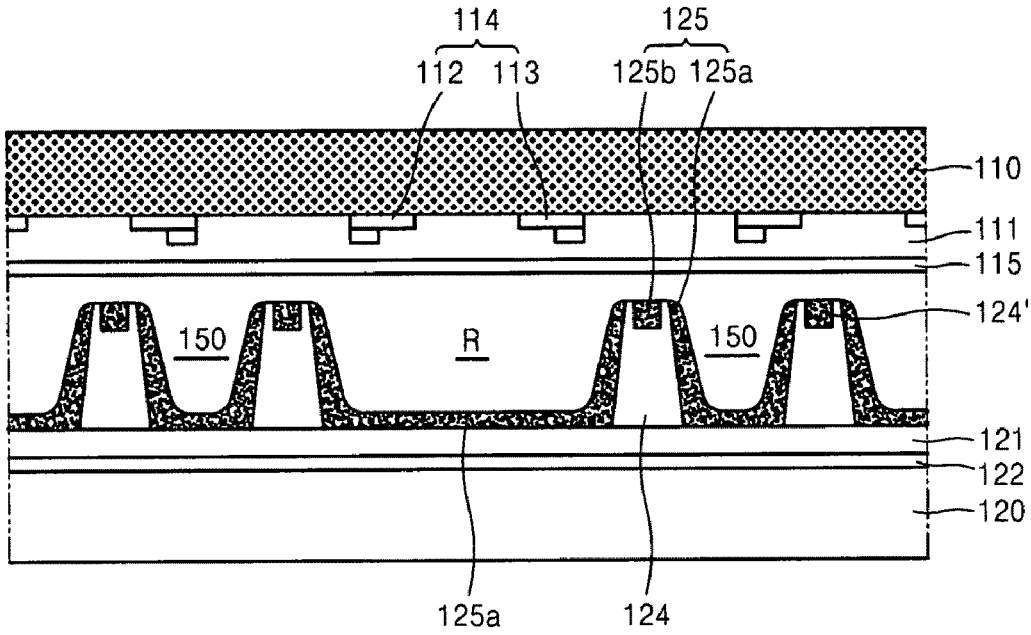
FIG. 10 illustrates a cross-sectional view along line X-X of FIG. 9.

FIGS. 9-10 illustrate exploded perspective view and a corresponding cross sectional view of a PDP according to still another embodiment of the present invention. The PDP illustrated in FIGS. 9-10 may be substantially similar to the PDP described previously with respect to FIGS. 1-4, with the exception of having grooves 224' for holding the second phosphor portions 125*b*. The grooves 224' may be formed in upper portions of the horizontal barrier portions 124 along the second direction, e.g., the y-axis, as illustrated in FIGS. 9-10.

The grooves 224' may extend along each horizontal barrier portions 124 in the second direction, and may have a substantially same length as the horizontal barrier portions 124. The grooves 224' may be formed to a predetermined depth along a third direction, e.g., the z-axis, so that the second phosphor portions 126 may be coated therein. Accordingly, the grooves 224' may shield an interior of each discharging cell 140 from adjacent second phosphor portions 125*b*, thereby substantially minimizing electrical effects therebetween.

More specifically, a surface of the second phosphor portions 125*b* may have a predetermined polarity, i.e., a negative polarity or a positive polarity, thereby potentially exerting an electrostatic force on charged particles in the discharge cell 140. As such, an erroneous discharge may be potentially generated between adjacent discharge cells 140 along the first direction, i.e., discharge cells having horizontal barrier ribs 124 therebetween. Accordingly, the grooves 224' of the PDP may advantageous in electrically hiding the second phosphor portions 125*b*6.

Example

A PDP formed according to an embodiment of the present invention, i.e., a PDP illustrated in FIGS. 7-8, was compared to a conventional PDP. Formation, i.e., method and materials, of the two PDPs was substantially similar with the exception of forming colored first and second phosphor portions 125*a* and 125*b* in the PDP formed according to the present invention and forming substantially white first and second phosphor portions 125*a* and 125*b* in the conventional PDP. The two PDPs were compared in terms of external light reflection brightness. The PDP according to an embodiment of the present invention exhibited external light reflection brightness of 11 cd/m$^2$, and the conventional PDP exhibited external light reflection brightness of 13 cd/m$^2$.

The external light reflection brightness difference between the two PDPs was used to calculate a bright room contrast ratio of each PDP according to the following equation:

$$\text{bright room contrast ratio} = \frac{\text{peak brightness} + \text{white brightness}}{\text{external light reflection brightness} + \text{white brightness}}$$

where the peak brightness denotes a highest brightness that can be obtained by a panel, i.e., a brightness when a gray level of 256 is displayed, and the white brightness denotes a lowest brightness that can be obtained by the panel, i.e., a brightness when a gray level of 0 is displayed.

The PDP according to an embodiment of the present invention exhibited a bright room contrast ratio of 90:1. The conventional PDP exhibited a bright room contrast ratio of 75:1. In other words, the PDP according to an embodiment of the present invention exhibited a substantially higher bright room contrast ratio, thereby providing an improved image quality.

Embodiments of the present invention may be advantageous in providing colored phosphors, barrier ribs, and substrate instead of conventionally white elements in order to reduce reflection of external light. The colors employed in the present invention may be complementary to each other, so overlapping portions of elements having complimentary colors may form a substantially dark color to provide a substantially dark image display surface for the PDP. Hence, special black stripes required in conventional art in order to absorb external light may not be needed, thereby reducing manufacturing costs and process time, i.e., number of manufacturing stages, of the PDP. Thus, the production yield of the PDP may be increased.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A plasma display panel (PDP), comprising:

a front substrate providing an image display surface;

a rear substrate facing the front substrate;

barrier ribs arranged between the front and rear substrates to define a plurality of discharge cells;

a plurality of discharge electrodes extending across the discharge cells to generate a discharge;

a front dielectric layer on the front substrate to bury the discharge electrodes;

first phosphors coated within the discharge cells;

second phosphors on upper surfaces of the barrier ribs and extending from the first phosphors; and a discharge gas filled into the discharge cells, wherein one or more of the front substrate, the front dielectric layer, and the barrier ribs is colored with a first color, and the first and second phosphors are colored with a second color, the first color and the second color being complementary to each other.

2. The PDP as claimed in claim 1, wherein the first color and the second color are different from each other.

3. The PDP as claimed in claim 1, wherein the first color is substantially blue or substantially orange, and the second color is substantially orange or substantially blue, respectively.

4. The PDP as claimed in claim 1, wherein the first phosphors include red phosphors, green phosphors, and blue phosphors, at least one of the red, green, and blue phosphors being colored with the second color.

5. The PDP as claimed in claim 4, wherein the red and blue phosphors are colored with the second color and the green phosphors are not colored.

6. The PDP as claimed in claim 1, wherein the barrier ribs include vertical barrier rib portions extending along a first direction and parallel to each other between discharge cells, and horizontal barrier rib portions extending along a second direction and parallel to each other to connect the vertical barrier rib portions.

7. The PDP as claimed in claim 6, wherein the second phosphors are on at least upper surfaces of the horizontal barrier rib portions.

8. The PDP as claimed in claim 7, further comprising grooves in the horizontal barrier rib portions along the second direction, the second phosphors being in the grooves.

9. The PDP as claimed in claim 6, wherein the barrier ribs further include bridges along the first direction, each bridge positioned between two horizontal barrier rib portions.

10. The PDP as claimed in claim 9, wherein the second phosphors are on upper surfaces of the horizontal barrier rib portions and of the bridges.

11. The PDP as claimed in claim 1, wherein the front substrate is colored with the first color and at least upper surfaces of the barrier ribs are colored with a third color.

12. The PDP as claimed in claim 11, wherein the third color of the barrier ribs is complementary with respect to the first color of the front substrate.

13. The PDP as claimed in claim 11, wherein the third color of the barrier ribs is substantially identical to the second color of the first and second phosphors.

14. The PDP as claimed in claim 13, wherein the third color of the barrier ribs and the second color of the first and second phosphors are complementary with respect to the first color of the front substrate.

15. The PDP as claimed in claim 11, wherein the front dielectric layer is colored with a fourth color.

16. The PDP as claimed in claim 15, wherein the fourth color of the dielectric layer is complementary with respect to the second color of the first and second phosphors.

17. The PDP as claimed in claim 15, wherein the fourth color of the front dielectric layer is substantially identical to the first color of the front substrate.

18. The PDP as claimed in claim 17, wherein the fourth color of the front dielectric layer and the first color of the front substrate are complementary with respect to the second color of the first and second phosphors.

19. The PDP as claimed in claim 1, wherein the front dielectric layer is colored with the first color and at least front portions of the barrier ribs are colored with a third color.

20. The PDP as claimed in claim 19, wherein the third color of the barrier ribs is complementary with respect to the first color of the front dielectric layer.

21. The PDP as claimed in claim 17, wherein the third color of the barrier ribs is substantially identical to the second color of the first and second phosphors.

22. The PDP as claimed in claim 21, wherein the third color of the barrier ribs and the second color of the first and second phosphors are complementary with respect to the first color of the front dielectric layer.

23. The PDP as claimed in claim 1, wherein at least upper surfaces of the barrier ribs are colored with the first color.

24. The PDP as claimed in claim 1, wherein the first phosphors and the second phosphors have a substantially same composition, the first and second phosphors being coated according to a dispenser method in a single cycle.

* * * * *